US009312649B2

(12) United States Patent
Wang et al.

(10) Patent No.: US 9,312,649 B2
(45) Date of Patent: Apr. 12, 2016

(54) BACKWARD COMPATIBLE MULTICHANNEL CONNECTOR

(71) Applicant: THALES DEFENSE & SECURITY, INC., Clarksburg, MD (US)

(72) Inventors: Haidong Wang, Gaithersburg, MD (US); Douglas Bell, Gaithersburg, MD (US); Steven Kutchi, Frederick, MD (US)

(73) Assignee: THALES DEFENSE & SECURITY, INC., Clarksburg, MD (US)

( * ) Notice: Subject to any disclaimer, the term of this patent is extended or adjusted under 35 U.S.C. 154(b) by 145 days.

(21) Appl. No.: 14/161,608

(22) Filed: Jan. 22, 2014

(65) Prior Publication Data

US 2014/0206239 A1 Jul. 24, 2014

Related U.S. Application Data

(60) Provisional application No. 61/755,809, filed on Jan. 23, 2013.

(51) Int. Cl.

| | |
|---|---|
| ***H01R 13/64*** | (2006.01) |
| ***H01R 24/68*** | (2011.01) |
| *H01R 107/00* | (2006.01) |

(52) U.S. Cl.

CPC ..... *H01R 24/68* (2013.01); *H01R 2107/00* (2013.01); *Y10T 29/49208* (2015.01)

(58) Field of Classification Search

CPC ..... H01R 24/68; H01R 2107/00; Y10T 29/49208

USPC ..... 439/217–224

See application file for complete search history.

(56) References Cited

U.S. PATENT DOCUMENTS

| | | | | |
|---|---|---|---|---|
| 4,649,332 | A * | 3/1987 | Bell | 320/117 |
| 4,842,532 | A * | 6/1989 | Krause | 439/174 |
| 5,302,141 | A * | 4/1994 | O'Reilly et al. | 439/680 |
| 6,422,884 | B1 * | 7/2002 | Babasick et al. | 439/222 |
| 7,070,433 | B2 * | 7/2006 | Joegel et al. | 439/218 |

* cited by examiner

*Primary Examiner* — Khiem Nguyen

(74) *Attorney, Agent, or Firm* — Arent Fox LLP

(57) ABSTRACT

A connector includes a housing configured to accommodate a plurality of contact pins, the housing including a plurality of contact pin locations, wherein the plurality of contact pin locations include a first set of contact pin locations designated for a first channel and a second set of contact pin locations designated for a second channel, a first set of contact pins disposed at the first set of contact pin locations, the first set of contact pins configured to carry a first signal associated with the first channel, and a second set of contact pins disposed at the second set of contact pin locations, the second set of contact pins configured to carry a second signal associated with the second channel.

9 Claims, 2 Drawing Sheets

BACKWARD COMPATIBLE MULTICHANNEL CONNECTOR

CLAIM OF PRIORITY UNDER 35 U.S.C. §119

This application claims the benefit of and priority to U.S. Provisional Patent Application No. 61/755,809, titled "BACKWARD COMPATIBLE MULTICHANNEL CONNECTOR," filed Jan. 23, 2013, the disclosure of which is hereby incorporated in its entirety by reference herein.

BACKGROUND

1. Field

Aspects of the present invention generally relate to a connector, and more particularly to a backward compatible multichannel connector.

2. Introduction

Some military multichannel tactical radios may support simultaneous two channel audio communications. One problem is that there is a large number of existing single channel audio accessories that use a military standard 6-pin design (e.g., U-239 interface). A proprietary 11-pin audio connector prevents the use of standard 6-pin audio accessories, even when the user only needs to access one of the two audio channels. Another issue is if the 11-pin audio accessory breaks, the widely available 6-pin audio accessory cannot be used as a backup. Further, military users may also use the same 6-pin audio connector to connect to key fill devices that typically require a standard 6-pin U-239 interface. A non-compatible 11-pin connector would limit the acceptance of the two channel radio by users who have easy access to, and heavy investment in, existing 6-pin audio accessories.

Some solutions of the related art include multi-pin audio connectors that are able to support multiple channels. However, these connectors are not able to accept the standard audio accessory, and therefore have no backward compatibility.

Therefore, there exists an unmet need in the art for a multi-pin connector that supports multiple channels (e.g., audio, data) and is backward compatible with at least connectors that only support a single channel.

SUMMARY

According to an aspect of the present invention, a connector may include a housing configured to accommodate a plurality of contact pins, the housing including a plurality of contact pin locations, wherein the plurality of contact pin locations include a first set of contact pin locations designated for a first channel and a second set of contact pin locations designated for a second channel; a first set of contact pins disposed at the first set of contact pin locations, the first set of contact pins being configured to carry a first signal associated with the first channel; and a second set of contact pins disposed at the second set of contact pin locations, the second set of contact pins being configured to carry a second signal associated with the second channel.

According to another aspect of the present invention, there is a method of using a connector having a housing configured to accommodate a plurality of contact pins, the housing including a plurality of contact pin locations, wherein the plurality of contact pin locations include a first set of contact pin locations designated for a first channel and a second set of contact pin locations designated for a second channel, the method may include: transmitting a first signal over a first set of contact pins disposed at the first set of contact pin locations; and transmitting a second signal over a second set of contact pins disposed at the second set of contact pin locations.

It is understood that other aspects of the invention will become readily apparent to those skilled in the art from the following detailed description, wherein various aspects of the present invention are shown and described by way of illustration only. As will be understood, the present invention is capable of other and different variations and its several details are capable of modification in various other respects, all without departing from the scope of the invention. Accordingly, the drawings and detailed description are to be regarded as illustrative in nature and not as restrictive.

BRIEF DESCRIPTION OF THE DRAWINGS

These and other sample aspects of the disclosure will be described in the detailed description and the appended claims that follow, and in the accompanying drawings, wherein:

Figure 1:
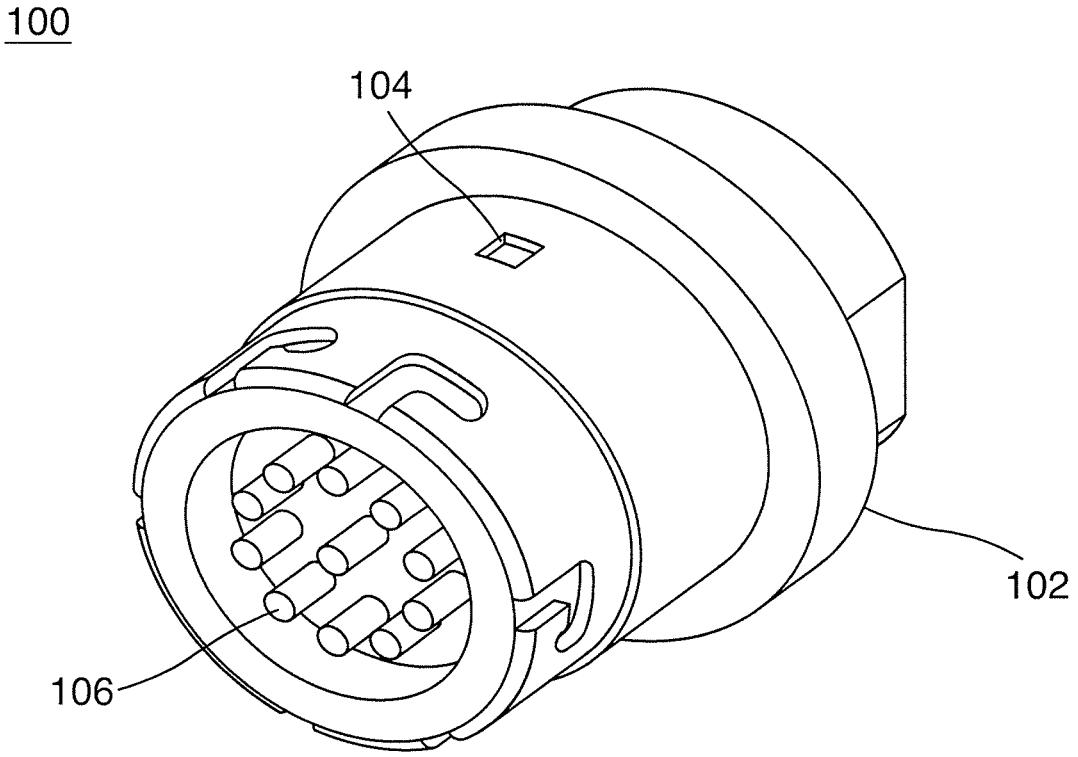
FIG. 1 is an example representative diagram illustrating a multichannel connector in accordance with aspects of the present invention.

In accordance with common practice, the various features illustrated in the drawings may be simplified for clarity. Thus, the drawings may not depict all of the components of a given apparatus or method. In addition, like reference numerals may be used to denote like features throughout the specification and figures.

DETAILED DESCRIPTION

Various aspects of the present invention are described below. It should be apparent that the teachings herein may be incorporated in a wide variety of forms and that any specific structure, function, or both being disclosed herein may be merely representative. Based on the teachings herein, one skilled in the art should appreciate that an aspect disclosed may be implemented independently of any other aspects, and that two or more aspects may be combined in various ways. For example, an apparatus may be implemented or a method may be practiced using and/or excluding any number of the aspects set forth herein. In addition, such an apparatus may be implemented or such a method may be practiced using other structure, functionality, or structure and functionality, in addition to or other than one or more of the aspects set forth herein. An aspect may comprise one or more elements of a claim.

Various aspects of the present invention solve the above-identified needs, as well as others, via devices, methods, and systems capable of providing integrated battery power control.

FIG. 1 is an example representative diagram illustrating a multichannel connector 100 in accordance with aspects of the present invention. The multichannel connector may include a housing 102, multiple notches 104 in the housing 102, and a plurality of pins 106. The configuration of the notches 104 and pins 106 may provide support for multiple audio/data channels and/or backward compatibility with connectors that may only support a single audio/data channel, for example.

The positioning and signal definition of the pins 106 may be such that, when a single channel connector is mated with the multichannel connector 100 at a first alignment position associated with one of the notches 104, the single channel connector pins are connected to one of the channels. By connecting the single channel connector to the multichannel connector 100 at a different alignment position associated with another one of the notches 104, a different channel of the multiple channels may be connected to the mated single channel connector.

The multichannel connector 100 may also be compatible with a mating multichannel connector. Additional mechanical features of the connector may be designed to prevent or inhibit misalignment of the pins and ensure proper connectivity. Pin assignments may also be designed such that no misroute of information can occur (or such misroute may be inhibited) among multiple channels when the connectors are not mated properly.

Figure 2:
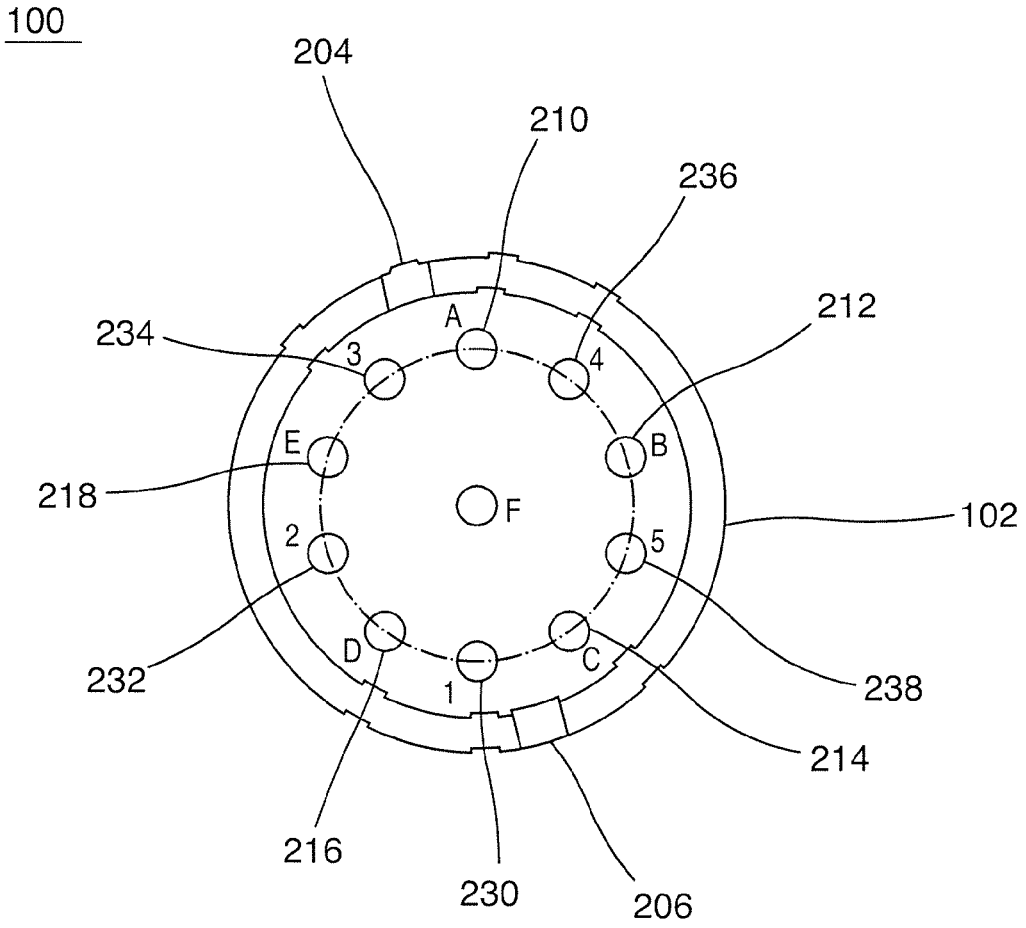
FIG. 2 is an example representative diagram illustrating a multichannel connector in accordance with aspects of the present invention.

FIG. 2 is an example representative diagram illustrating notch and pin positions of the multichannel connector 100 of FIG. 1, in accordance with aspects of the present invention. As shown in FIG. 2, notches 204 and 206 may correspond to the notches 104 shown in FIG. 1. Similarly, pins 210, 212, 214, 216, 218, 220, 230, 232, 234, 236, and 238 may correspond to the pins 106 shown in FIG. 1. Pins 210, 212, 214, 216, and 218 may be assigned to a first channel; and pins 230, 232, 234, 236, and 238 may be assigned to a second channel, for example.

The multichannel connector 100 may address backward compatibility needs by providing pin positions and electrical signal assignment in a manner and/or arrangement so as to superimposedly accommodate two 6-pin connector pin patterns offset by 180 degrees. For example, if a 6-pin connector is mated with the multichannel connector 100 connector at an alignment position associated with notch 204, the 6-pin connector may be connected to pins 210, 212, 214, 216, and 218, which may be assigned to a first channel, for example. On the other hand, if a 6-pin connector is mated with the multichannel connector 100 at an alignment position associated with notch 206, the 6-pin connector may be connected to pins 230, 232, 234, 236, and 238, which may be assigned to a second channel, for example. A mating connector having 11 pins may also be used to access both the first and second channels of the multichannel connector contemporaneously.

In the above manner, the example multichannel connector 100 may allow two channel support while retaining backward compatibility with legacy single channel accessories. Among other things, the multichannel connector 100 may solve a difficult dilemma between providing new capabilities, such as multi-channel support, and preserving backward compatibility with deployed accessories.

While aspects of the present invention have been described in connection with preferred implementations, it will be understood by those skilled in the art that variations and modifications described above may be made without departing from the scope hereof. Other aspects will be apparent to those skilled in the art from a consideration of the specification or from a practice of the aspects of the invention disclosed herein.

What is claimed is:

1. A connector, comprising:

a housing configured to accommodate a plurality of contact pins, the housing including a plurality of contact pin locations, wherein the plurality of contact pin locations include a first set of contact pin locations designated for a first channel and a second set of contact pin locations designated for a second channel;

a first set of contact pins disposed at the first set of contact pin locations, the first set of contact pins being configured to carry a first signal associated with the first channel; and a second set of contact pins disposed at the second set of contact pin locations, the second set of contact pins being configured to carry a second signal associated with the second channel, wherein the housing comprises a first alignment position and a second alignment position, wherein mating the connector with a single channel connector at the first alignment position connects the first channel to the single channel connector, and wherein mating the connector with the single channel connector at the second alignment position connects the second channel to the mated single channel connector.

2. The connector of claim 1, wherein the first set of contact pin locations and the second set of contact pin locations are positioned in a circular configuration.

3. The connector of claim 2, wherein each pin of the first set of contact pins is disposed between two pins of the second set of contact pins within the circular configuration.

4. The connector of claim 1, wherein the housing comprises a first notch associated with the first alignment position and a second notch associated with the second alignment position, and wherein the first notch facilitates mating the connector with the single channel connector at the first alignment position, and the second notch facilitates mating the connector with the single channel connector at the second alignment position.

5. The connector of claim 1, wherein mating the connector with a multiple channel connector at the first alignment position connects the first channel and the second channel to the multiple channel connector.

6. A method of using a connector having a housing configured to accommodate a plurality of contact pins, the housing including a plurality of contact pin locations, wherein the plurality of contact pin locations include a first set of contact pin locations designated for a first channel and a second set of contact pin locations designated for a second channel, the method comprising:

transmitting a first signal over a first set of contact pins disposed at the first set of contact pin locations; and transmitting a second signal over a second set of contact pins disposed at the second set of contact pin locations, wherein the housing comprises a first alignment position and a second alignment position, and wherein the method further comprises:

connecting the first channel to a single channel connector by mating the connector with the single channel connector at the first alignment position; and connecting the second channel to the single channel connector by mating the connector with the single channel connector at the second alignment position.

7. The method of claim 6, wherein the first set of contact pin locations and the second set of contact pin locations are positioned in a circular configuration.

8. The method of claim 7, wherein each pin of the first set of contact pins is positioned between two pins of the second set of contact pins within the circular configuration.

9. The method of claim 6, further comprising:

connecting the first channel and the second channel to a multiple channel connector by mating the connector with the multiple channel connector at the first alignment position.

* * * * *